US011673196B2

(12) United States Patent
Zhang et al.

(10) Patent No.: US 11,673,196 B2
(45) Date of Patent: Jun. 13, 2023

(54) METAL MATERIAL SINTERING DENSIFICATION AND GRAIN SIZE CONTROL METHOD

(71) Applicant: UNIVERSITY OF SCIENCE AND TECHNOLOGY BEIJING

(72) Inventors: Lin Zhang, Beijing (CN); Xuanhui Qu, Beijing (CN); Xingyu Li, Beijing (CN); Mingli Qin, Beijing (CN); Yanhao Dong, Beijing (CN); Ju Li, Beijing (CN); Guanghua Wang, Beijing (CN); Ying Long, Beijing (CN); Wei Zhong, Beijing (CN)

(73) Assignee: UNIVERSITY OF SCIENCE AND TECHNOLOGY BEIJING, Beijing (CN)

( * ) Notice: Subject to any disclaimer, the term of this patent is extended or adjusted under 35 U.S.C. 154(b) by 585 days.

(21) Appl. No.: 16/793,897

(22) Filed: Feb. 18, 2020

(65) Prior Publication Data

US 2020/0198013 A1 Jun. 25, 2020

Related U.S. Application Data

(63) Continuation of application No. PCT/CN2018/123568, filed on Dec. 25, 2018.

(30) Foreign Application Priority Data

Dec. 24, 2018 (CN) ..... 201811583483.7

(51) Int. Cl.
*B22F 3/16* (2006.01)
*B22F 9/02* (2006.01)
(Continued)

(52) U.S. Cl.
CPC ..... *B22F 3/16* (2013.01); *B22F 1/05* (2022.01); *B22F 1/065* (2022.01); *B22F 1/10* (2022.01);
(Continued)

(58) Field of Classification Search
CPC .. B22F 1/05; B22F 1/065; B22F 1/142; B22F 1/10; B22F 3/04; B22F 3/1017;
(Continued)

(56) References Cited

U.S. PATENT DOCUMENTS

2018/0326483 A1* 11/2018 Choi ..... B22F 3/1017
2018/0366247 A1* 12/2018 Li ..... H01F 1/0557

FOREIGN PATENT DOCUMENTS

CN 101805867 A 8/2010
CN 105478776 A 4/2016
(Continued)

OTHER PUBLICATIONS

Search Report of PCT/CN2018/123568, (dated Sep. 12, 2019).
Written Opinion of PCT/CN2018/123568, (dated Sep. 12, 2019).

*Primary Examiner* — Anthony J Zimmer
*Assistant Examiner* — Dean Mazzola

(57) ABSTRACT

A method to achieve full densification and grain size control for sintering metal materials, wherein raw material powder is deagglomerated to obtain deagglomerated powder with dispersion. The deagglomerated powder is granulated by spray granulation. The granulated particles are processed by high-pressure die pressing and cold isostatic pressing. The powder compact is sintered by two-step pressureless sintering. The first step is to heat up the powder compact to a higher temperature and hold for a short time to obtain 75-85% theoretical density; the second step is to cool down powder compact to a lower temperature and hold for a long time. The two-step sintering can decrease the sintering
(Continued)

temperature, so that the powder compact can be densified at a lower temperature. Thus, the obtained refractory metal product is densified, with ultrafine grains, uniform grain size distribution, and outstanding mechanical properties.

10 Claims, 5 Drawing Sheets

(51) Int. Cl.

| | |
|---|---|
| ***B22F 1/05*** | (2022.01) |
| ***B22F 1/10*** | (2022.01) |
| ***B22F 1/065*** | (2022.01) |
| ***B22F 1/142*** | (2022.01) |
| ***B22F 9/04*** | (2006.01) |

(52) U.S. Cl.
CPC ..... *B22F 1/142* (2022.01); *B22F 9/026* (2013.01); *B22F 2009/041* (2013.01); *B22F 2201/013* (2013.01); *B22F 2201/11* (2013.01); *B22F 2203/11* (2013.01); *B22F 2203/13* (2013.01); *B22F 2301/20* (2013.01); *B22F 2998/10* (2013.01)

(58) Field of Classification Search
CPC .... B22F 3/12; B22F 3/16; B22F 9/026; B22F 3/1028; B22F 2009/041; B22F 2201/013; B22F 2201/11; B22F 2203/11; B22F 2301/20
See application file for complete search history.

(56) References Cited

FOREIGN PATENT DOCUMENTS

| | | | |
|---|---|---|---|
| CN | 105518169 | A | 4/2016 |
| CN | 106312057 | A | 1/2017 |
| CN | 108330371 | A | 7/2018 |
| CN | 108907211 | A | 11/2018 |
| CN | 109047780 | A | 12/2018 |
| CN | 109047781 | A | 12/2018 |
| JP | 05148568 | A | 6/1993 |
| JP | 2005150503 | A | 6/2005 |

* cited by examiner

METAL MATERIAL SINTERING DENSIFICATION AND GRAIN SIZE CONTROL METHOD

CROSS-REFERENCE TO RELATED APPLICATIONS

This application is a bypass continuation application of PCT Application No. PCT/CN2018/123568. This application claims priority from PCT Application No. PCT/CN2018/123568, filed Dec. 25, 2018 and CN Application No. 201811583483.7, filed Dec. 24, 2018, the contents of which are incorporated herein in the entirety by reference.

Some references, which may include patents, patent applications, and various publications, are cited and discussed in the description of the present disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE INVENTION

The present invention belongs to the technical field of powder metallurgy, in particular to a metal material sintering densification and grain size control method.

BACKGROUND OF THE INVENTION

Refractory metal materials are irreplaceable key materials in special application fields such as national defense, nuclear engineering, aviation and aerospace, electronics, and high-end equipment fields, etc. Tungsten and molybdenum target materials are important basic raw materials required in semiconductor large-scale integrated circuit, high-end display, solar photovoltaic power generation and other industries, and are used to produce electrodes, wiring metals, shielding metal materials, and barrier materials, etc. Tungsten and molybdenum target materials must have high-density and ultrafine grain size to ensure the uniformity of coating. In addition, the tungsten metal is the most promising material for plasma-facing first wall and spallation neutron source target. However, the low-temperature brittleness of tungsten is always the bottleneck problem that limits the application of the tungsten material, and severely increases the difficulties in the preparation and processing of tungsten products in complex shapes. It is always an important research direction of tungsten metal materials to improve the plasticity, decrease the ductile-brittle transition temperature and improve the high-temperature mechanical properties of tungsten. By refining the grains of tungsten, not only the ductile-brittle transition temperature of tungsten can be decreased, but also the high-temperature mechanical properties and thermal shock resistance of the material can be improved. However, owing to the high melting point, the self-diffusion coefficient of tungsten/molybdenum is low and the sintering performance is poor. The sintering of a refractory metal material is usually to heat up the compact to a maximum temperature (as high as 1,600-2,300° C.) and hold at the maximum temperature to obtain the highest density. The grains have a strong tendency of growth in the sintering process. Especially, the grains grow at a higher rate in the late stage of densification. Especially, for high-purity refractory metals, due to the lack of second-phase particles as the nucleation cores for recrystallization after the improvement of material purity, non-uniform grain growth may occur easily after thermal deformation, resulting in severe degradation of mechanical properties and service performance (e.g., sputtering performance) of the material. Presently, nanometer refractory metal powder is usually used as raw materials to prepare ultrafine grain refractory metals. Owing to the high grain boundary energy and surface activity energy of nanometer particles, the driving force of sintering is very high; the grains will grow rapidly once there are external driving conditions. Consequently, it is difficult to control the grain size. Two methods are often used in order to inhibit the growth of grains of refractory metals. One method is to employ a special sintering process and inhibit the growth of tungsten grains with technological means such as such as external force and auxiliary external field, etc. For example, hot isostatic compaction, plasma activated sintering, microwave sintering, and electric sintering under super-high pressure, etc., may be used. However, it is difficult to use those methods to prepare tungsten products in complex shapes. In the sintering process, the densification rate of the nanometer powder is high, but the growth rate of the grains is also high, and the sintered compact can't maintain the original nanometer crystal structure. In addition, the obvious agglomeration phenomenon of the nanometer particles leads to non-uniform growth of the grains and severely degraded properties of the refractory metal. Apparently, densification and grain growth are the two biggest problems in nanometer powder sintering at present. The second method is to add a second phase of nanometer oxide ($La_2O_3$, $Y_2O_3$, or $ZrO_2$) or carbide (TiC, ZrC, or HfC). Nanometer particles homogeneously dispersed in the matrix can restrain the migration of grain boundaries and dislocations, and thereby can inhibit grain growth, as well as significantly improve the strength at room temperature and high temperature, stability at high temperature, and recrystallization temperature of the refractory metal. However the addition of the second phase decreases the densification rate of the refractory metal product.

The present invention is a refractory metal powder sintering process based on pressureless sintering, which utilizes the dynamic difference between grain boundary diffusion and grain boundary migration to inhibit grain growth in the final stage. Nanometer/submicron refractory metal powder is used as a raw material, the raw material is pretreated first, and tungsten aggregates are prepared by spray granulation, then pressing and cold isostatic pressing are carried out, and then a two-step sintering process is used to prepare a high-density ultrafine grain refractory metal material. The first step of sintering is to quickly heat up the compact to a higher temperature $T_1$, hold at the temperature for a short time, then immediately cool down to a lower temperature $T_2$, and then hold at the temperature $T_2$ for a long time. The key to select the sintering temperature $T_1$ in the first step of sintering is to control the density of the refractory metal compact at 75-85% and ensure that the refractory metal compact has a fine and uniform pore structure. In the first-step sintering process, the raw powder in uneven grain size is coarsened to a certain degree, the grain size of the powder tends to be uniform, and a pore structure with uniform pore size is formed. The pores hinder the growth of the grains in the follow-up step, have a significant influence on the further densification of the compact in the second-step sintering process, and have a direct relation with the final density of the compact. An appropriate first-step sintering process must be used to obtain a certain temperature window in the second step of sintering and obtain high-density metal without obvious grain growth. An advantage of the method is that an almost fully compact ultrafine grain refractory metal material without grain growth can be prepared. The two-step sintering method can greatly decrease the sintering temperature. The temperature of the first step of sintering is lower than the conventional sintering temperature by 300-500° C., the energy consumption is reduced, grain boundary migration or grain growth can be inhibited, while grain boundary diffusion is not inhibited. In the second-step sintering process, the grain boundary migration is inhibited, while the grain boundary diffusion remains active. Therefore, the grains don't grow obviously, and a "freezing" effect on the grain structure is attained. Though the densification kinetics is slow in that stage, it is enough to achieve high density of the compact. The sintering temperature in the second step of sintering is lower, the pores in the compact are eliminated by means grain boundary diffusion and long-time temperature holding, and the density is improved without obvious grain growth. Since the method employs pressureless sintering, it solves the problem of accelerated growth of the grains of the refractory metal in the last stage of the conventional sintering process, and submicron grains can be obtained. Therefore, the method is helpful for improving the uniformity of the grains and inhibit abnormal grain growth. Thus, an almost fully compact tungsten product with density higher than 99% can be obtained, and nearly final forming of the refractory metal product can be achieved. The ultrafine grains effectively improve the mechanical properties of tungsten and molybdenum materials, and expand the scope of application of the materials. The method provided in the present invention is a low-cost method for preparing ultrafine grain refractory metals, and is also applicable to other metal materials.

Therefore, a heretofore unaddressed need exists in the art to address the aforementioned deficiencies and inadequacies.

SUMMARY OF THE INVENTION

The technical problem to be solved in the present invention is to provide a metal material sintering densification and grain size control method, in order to solve the technical problems that the existing tungsten metal sintered products have poor mechanical properties owing to difficulties in densification and grain size and poor structural homogeneity in the prior art.

The present invention solves the above technical problem with the following technical scheme: First, a nanometer/submicron refractory metal powder raw material is deagglomerated with a high-speed helical blade mixer, and then formed powder with high filling performance and fluidity is obtained by spray granulation. Next, high-pressure die pressing and cold isostatic pressing are used to carry out forming twice, to achieve high compact density and improve compact uniformity. Finally, the accelerated grain growth in the late stage of sintering of the refractory metal powder is inhibited through a two-step sintering process, the tungsten compact is fully densified under a lower temperature condition, and grain growth is controlled effectively at the same time. Thus, a pure tungsten product with high density, ultrafine grains, and high thermo-mechanical performing is obtained.

To attain the object of the present invention, the following technical scheme of preparation is employed: A metal material sintering densification and grain size control method, comprising the following steps:

first, processing raw material powder by deagglomeration to obtain deagglomerated powder with excellent dispersion; granulating the deagglomerated powder by spray granulation to improve powder flowability and density uniformity of powder compact and obtain granulated particles in an approximately spherical shape; processing the obtained granulated particles in an approximately spherical shape by high-pressure die pressing and cold isostatic pressing to obtain a powder compact; sintering the powder compact by two-step pressureless sintering, i.e., the first step of sintering is to heat up the powder compact quickly to a specified temperature, hold the powder compact at the temperature for a short time and control the density at 75-85%, and the second step of sintering is to cool down the powder compact to a specified temperature and hold the powder compact at the temperature for a long time to further eliminate residual pores, so as to a obtain high-density ultrafine metal.

Furthermore, the specific steps of the method are:

S1: using metal powder as a raw material, and processing the raw material powder by deagglomeration with a high-speed helical blade mixer at 2,000-3,000 rpm blade rotation speed for 0.5-2 h, to obtain deagglomerated powder;

S2: first, mixing a binder and deionized water homogeneously to prepare a solution A, in which the content of the binder is 5-15 wt. %;

then, adding the deagglomerated raw material powder obtained in the step S1 into the solution A and stirring the solution mechanically to a homogeneous state, so as to obtain a slurry;

granulating the obtained slurry by spray granulation with a centrifugal atomizing drier at 8,000-15,000 r/min rotation speed, 100-300 kPa atomizing pressure, and 90-150° C. drying temperature;

loading the granulated powder into a tube heating oven and adding high-purity hydrogen into the tube heating oven for degreasing and reduction at 550-700° C. processing temperature and 5-10° C./min. heating rate, and holding for 60-120 min., to obtain granulated particles in an approximately spherical shape;

S3: pressing the granulated powder by high-pressure die pressing at 700-1,000 MPa pressing pressure, and holding for 0.5-1.5 min. to obtain a preformed powder compact, loading the preformed powder compact into a jacketed mold and performing cold isostatic pressing at 200-280 MPa, and holding for 5-10 min., to obtain a powder compact;

S4: performing two-step sintering: first, in the first step of sintering, heating up the powder compact obtained in the step S3 at a specified heating rate to a temperature $T_1$ and holding at the temperature $T_1$, to obtain a one-step sintered compact; then, in the second step of sintering, cooling down the one-step sintered compact from the temperature $T_1$ to a temperature $T_2$ at a specified cooling rate, and holding at the temperature $T_2$, so as to obtain a metal material with ultrafine grains finally, wherein, the temperature $T_2$ is lower than the temperature $T_1$ by 50-250° C., and the holding time for $T_1$ in the first step is shorter than the holding time for $T_2$ in the second step.

Furthermore, in the step S1, the metal powder comprises a refractory metal; the particle size of the deagglomerated powder is smaller than 0.5 μm.

Furthermore, in the step S2, the binder is polyvinyl alcohol, polyethylene glycol, stearic acid or paraffin; the solid content in the slurry is 60-85 wt. %.

Furthermore, in the step S3, the relative density of the powder compact is higher than 50%.

Furthermore, in the first step of sintering in the step S4, the powder compact is sintered in a hydrogen atmosphere by heating up the powder compact to the temperature $T_1$ at 5° C./min heating rate, the temperature $T_1$ is 1,200-1,500° C. and the holding time for $T_1$ is 1-2 h.

Furthermore, in the second step of sintering in the step S4, the shielding gas atmosphere is hydrogen or argon gas atmosphere, the temperature is decreased from the temperature $T_1$ to the temperature $T_2$ at 15-25° C./min cooling rate, and the holding time for $T_2$ is 10-60 h.

Furthermore, the density of the one-step sintered compact is 75-85%, the grain size is 0.5-1 μm, and the pore distribution is uniform.

Furthermore, the grain size of the obtained ultrafine grain metal/one-step sintered compact is less than or equal to 1.5.

Furthermore, the density of the ultrafine grain metal is higher than 98%.

Compared with the one-step sintered compact after the first step of sintering, the grains have no obvious growth in the second step of sintering.

Compared with the prior art, the present invention has the following advantages:

I. The characteristics of the initial powder also have a significantly influence on the two-step sintering process. In view that the powder is nanometer or sub-micrometer powder and irregular agglomeration may occur more easily and pores may be formed more easily in the aggregates in the case of smaller particles, the refractory metal powder particles are driven by the high-speed rotating blades to rotate at a high speed, and the aggregates in the nanometer powder are deagglomerated under the shearing force of the blades and high-speed collision. Thus, the obtained powder particles have narrower grain size distribution and better dispersion performance. The agglomerates of the nanometer powder and the pores formed in the grains in the sintering process are eliminated. Such pores are difficult to eliminate even through the follow-up high-temperature sintering process. In addition, the abnormal growth of the grains is greatly reduced, and the uniformity of grain distribution in the sintered compact is improved.

II. Compare with the original powder with irregular agglomerates, the granulated powder can significantly improve the fluidity of the powder particles and the mold filling uniformity in the forming process, and it is helpful for achieving higher powder accumulation density and uniform density distribution in different parts of the powder compact. The cold isostatic pressing technique also improves the density distribution difference in the powder compact, and is helpful for uniform shrinkage of the plate compact in the sintering process. The formation of a pore structure with uniform pore size in the one-step sintered compact can effectively pin the migration of the grain boundaries, and provides a basis for further densification in the second-step sintering process.

III. The two-step sintering process can effectively inhibit the grain growth in the later stage of sintering in the traditional sintering process, promote densification and reduce grain growth. The prepared refractory metal can obtain high density while maintaining ultrafine grain size. Abnormal growth of the grains is essentially eliminated, the obtained refractory metal has high microstructure uniformity and significantly improved mechanical properties.

IV. Different shielding gas atmospheres are used in different sintering stages in the two-step sintering process: the shielding gas atmosphere in the first-step sintering process is hydrogen, and the shielding gas atmosphere in the second-step sintering process is argon. The hydrogen gas atmosphere used in the first step of sintering has a reduction and purification effect, can remove most of the oxygen impurity in the compact forming process, and thereby promote the densification process. The argon gas atmosphere used in the second step of sintering can effectively remove the water vapor generated in the hydrogen reduction process, inhibit the gas phase transport mechanism that results in grain growth coarsening, and thereby attain a grain growth coarsening inhibition effect.

V. Compared with the ordinary sintering process, the two-step sintering process decreases the sintering temperature by 300-500° C., and reduces the energy consumption and cost. The method is not limited to refractory metals such as tungsten and molybdenum, but also provides a new way for preparing of other high-density ultrafine grain metal materials.

BRIEF DESCRIPTION OF DRAWINGS

The accompanying drawings illustrate one or more embodiments of the present invention and, together with the written description, serve to explain the principles of the invention. Wherever possible, the same reference numbers are used throughout the drawings to refer to the same or like elements of an embodiment.

DETAILED DESCRIPTION OF THE EMBODIMENTS

Figure 1:
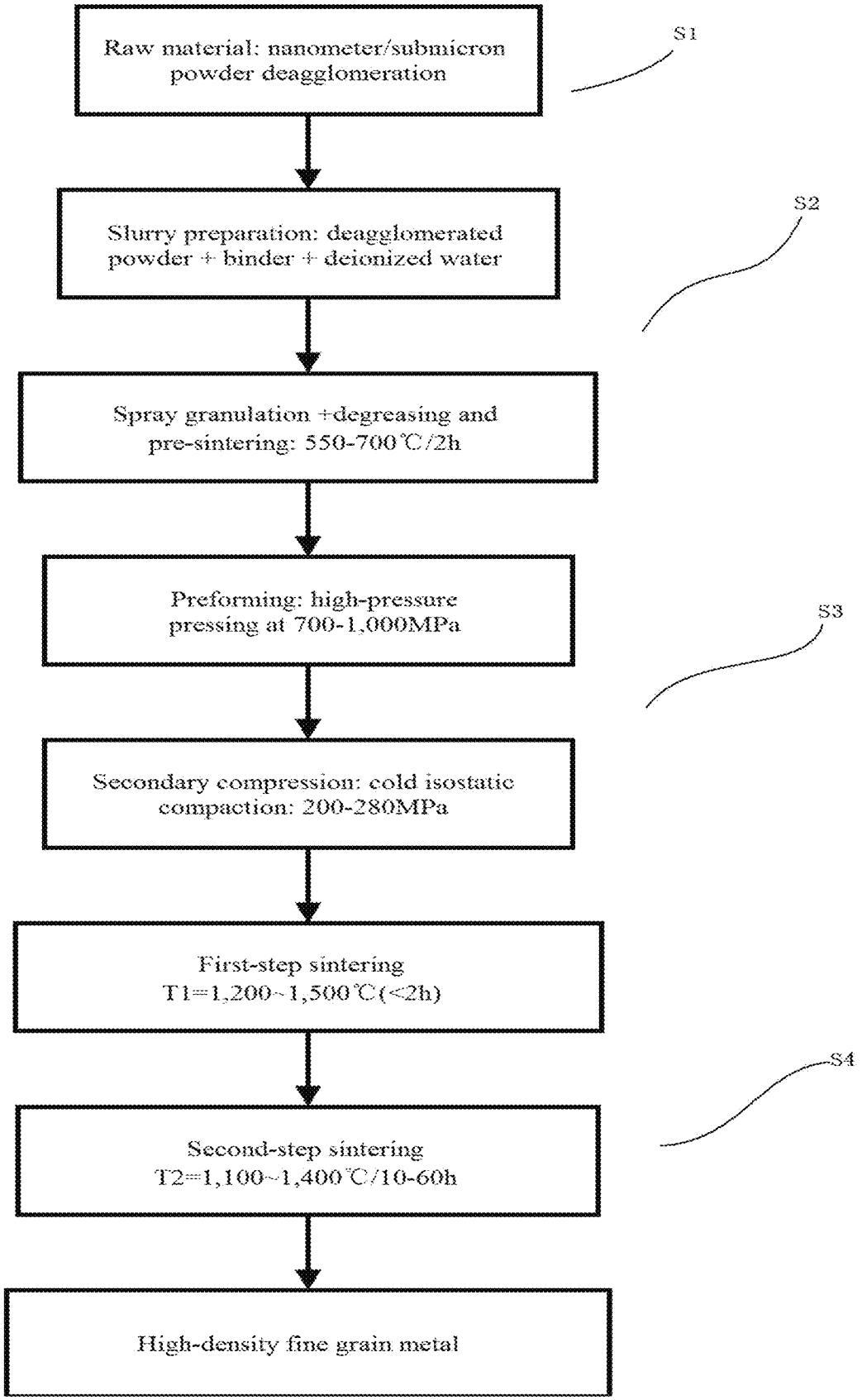
FIG. 1 is a process flow chart of the metal material sintering densification and grain size control method in the present invention.
Figure 2:
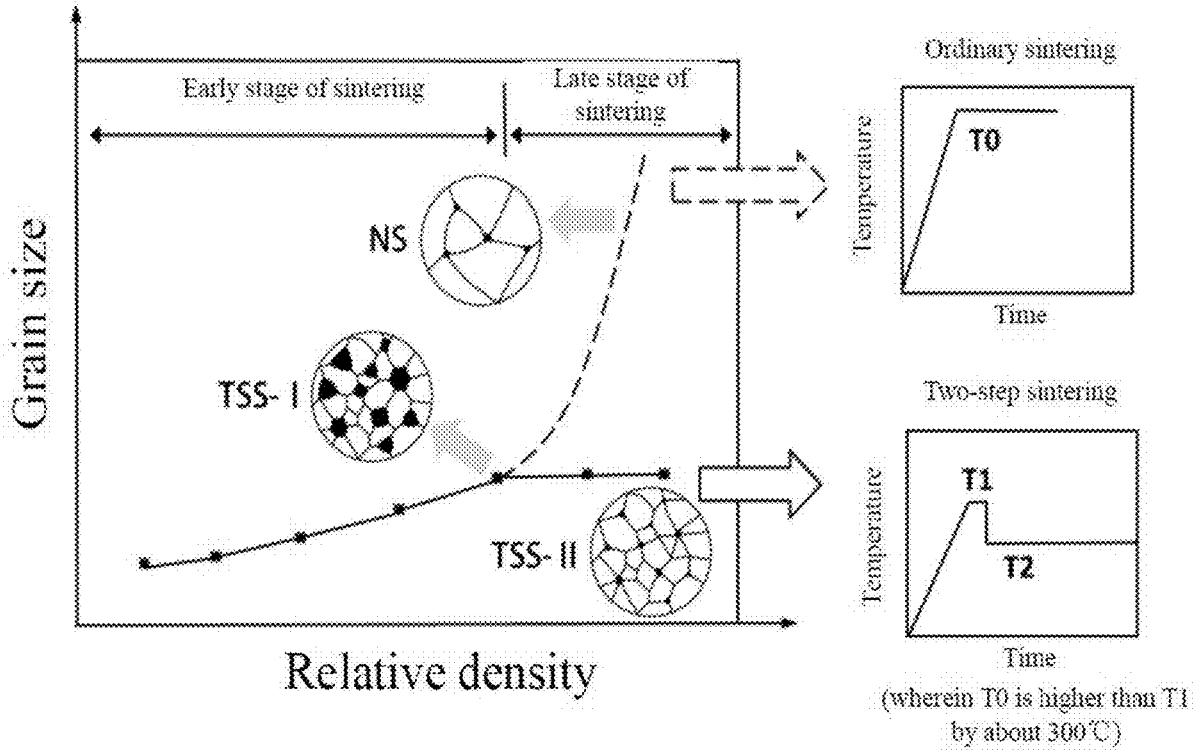
FIG. 2 is a schematic diagram of the two-step sintering process in the present invention. The first step of sintering is to rapidly heat up the powder compact to a higher temperature $T_1$ and hold at the temperature for a short time to control the density at 75-85%, then immediately cool down the powder compact to a lower temperature $T_2$ and carry out the second step of sintering, and hold at the temperature for a long time to further eliminate residual pores without grain growth. In the Figures, NS represents normal sintering, TSS-I represents the first step of sintering in the two-step sintering process, and TSS-II represents the second step of sintering in the two-step sintering process. Wherein, the sintering temperature $T_1$ in the two-step sintering process is lower than the sintering temperature $T_0$ of an normal sintering process by 300-500° C., and there is no obvious grain growth in the late stage of sintering in the two-step sintering process.
Figure 3:
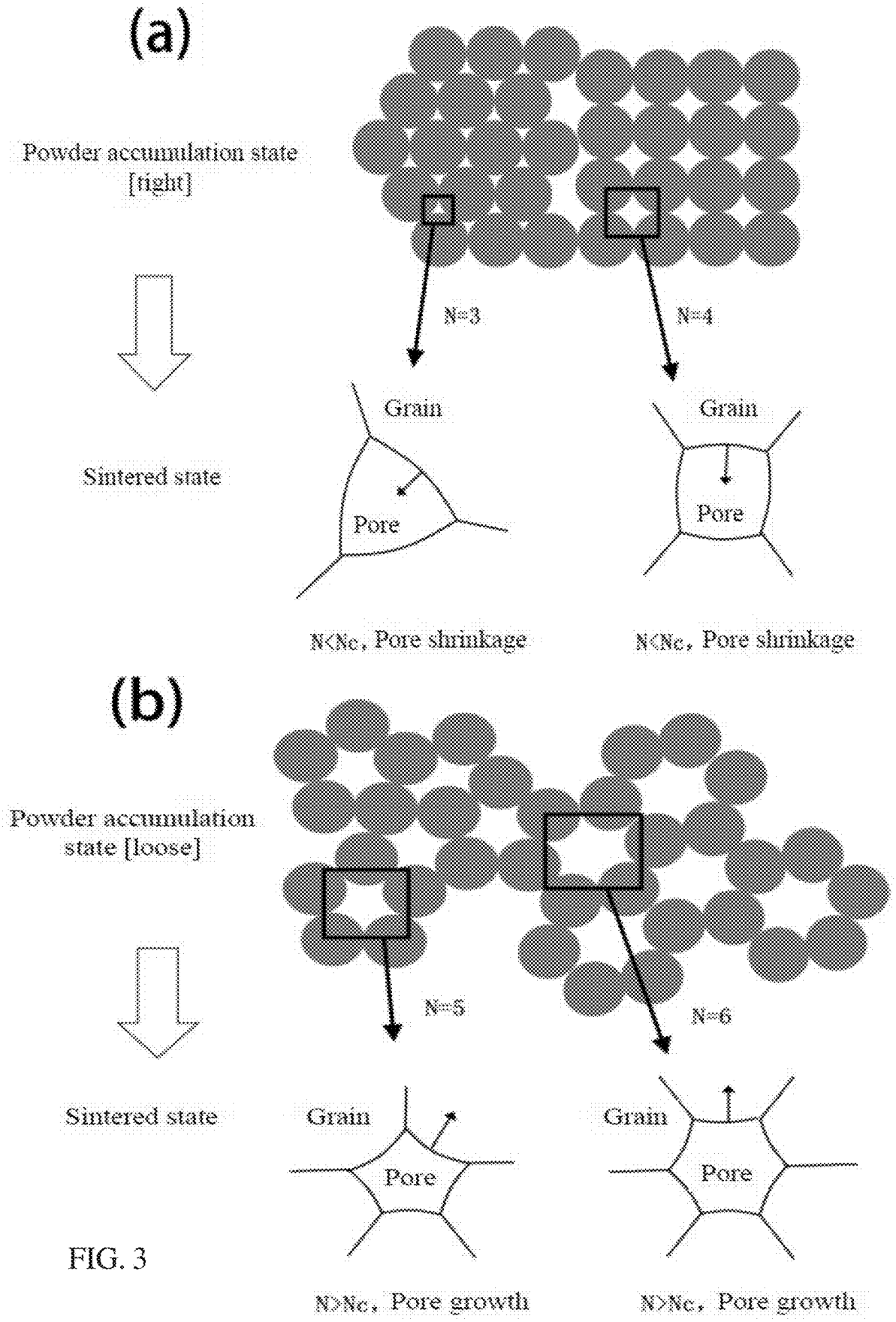
FIG. 3 is a schematic diagram of the influence of the powder accumulation state on the sintering. Kingery and Francois first recognized that there was a critical coordination number Nc of the pores in the powder sintering process in 1967. Suppose a pore is surrounded by N grains, where, N is related with the powder accumulation state in the early stage. Then, if N<Nc for a pore (the powder accumulation state is a tight state), the interface between the pore and the grains is recessed toward the pore, and the pore shrinks; if N>Nc for a pore (the powder accumulation state is a loose state), the interface protrudes toward the pore, and the pore grows. Especially, in a case that the densification driving force is great so that pores with N>Nc shrink, surely the neighboring grains grow abnormally. (a) is a tight powder accumulation state, in which the pores are easy to shrink during sintering; (b) is a loose powder accumulation state, in which the pores are difficult to shrink during sintering, resulting in higher densification driving force and aggravated grain growth in the densification process. Therefore, reducing large pores with N>Nc is one of the key factors to control the grain growth in the sintering process. It is feasible to improve the density of the raw compact and the state of powder accumulation.
Figure 4:
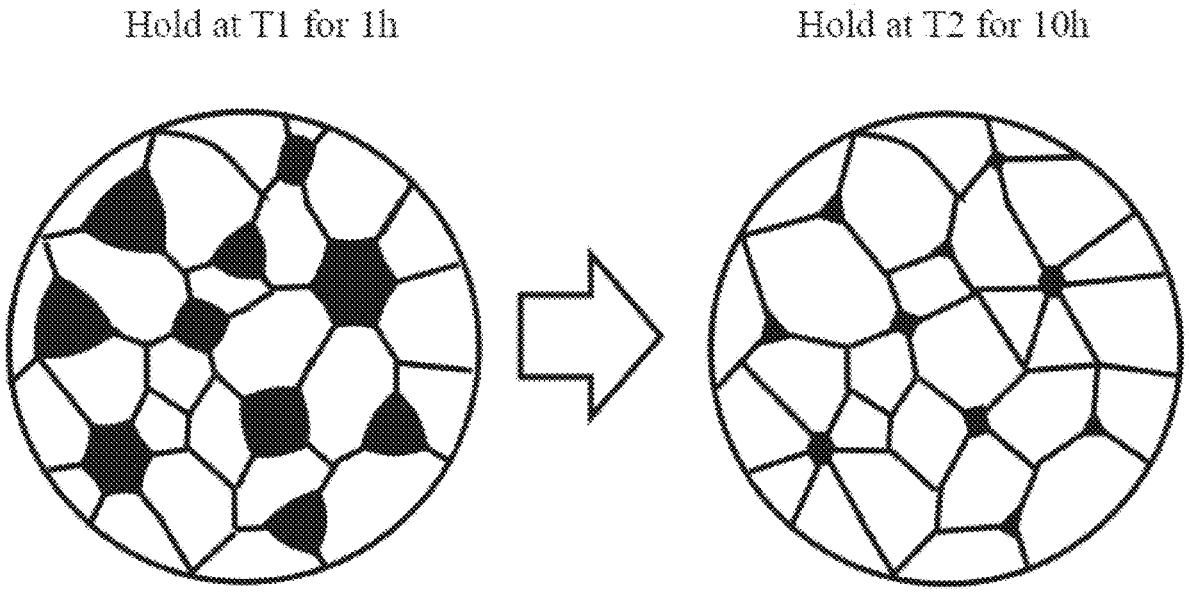
FIG. 4 is a schematic diagram of pore structure change of the sintered compact in the two-step sintering process. The pores are usually difficult to shrink in the later stage of sintering, and the further densification process in the later stage of sintering inevitably results in grain growth. With the traditional sintering method, the grain growth rate is often related to grain boundary mobility. According to the Brook velocity criterion, the relative velocity of movement between the pore and the grain boundary has an important influence on the grain growth. In a first case, i.e., the movement velocity of the grain boundary is quicker than that of the pore, the grain boundary will be disengaged from the pore and move freely, and consequently the pores remain inside the grains and difficult to shrink, or the grains grow abnormally; in a second case, the movement velocity of the pores at the grain boundary is lower than the movement velocity of the grain boundary but without disengagement, and the pinning effect of the pores inhibit the growth of the grains. In a third case, the movement velocity of the grain boundary is lower that the movement velocity of the pore spaces, and the movement of the grain boundary controls grain growth. Different from the free movement of the grain boundary in the first case, the second case and the third case involve a slow grain growth process. The mechanism of the two-step sintering is: in the first step, a certain density is achieved at a higher temperature $T_1$, i.e., closed pores are just formed. In the second step, at a lower temperature $T_2$, grain boundary mobility (which enables grain growth) has a larger activation energy than grain boundary diffusion (which enables porosity reduction and sintering densification), possibly by 3-/4-grain junction pinning, so that a suppression of grain growth while an activation of densification can be achieve.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure is thorough and complete, and will fully convey the scope of the invention to those skilled in the art. Like reference numerals refer to like elements throughout.

Embodiments of the invention are illustrated in detail hereinafter with reference to accompanying drawings. It should be understood that specific embodiments described herein are merely intended to explain the invention, but not intended to limit the invention.

Hereunder the technical scheme of the present invention will be further detailed in some embodiments, with reference to the accompanying drawings.

The metal material sintering densification and grain size control method provided in the present invention comprises the following steps:

first, processing raw material powder by deagglomeration to obtain deagglomerated powder with excellent dispersion; granulating the deagglomerated powder by spray granulation to improve powder flowability and density uniformity of powder compact and obtain granulated particles in an approximately spherical shape; processing the obtained granulated particles in an approximately spherical shape by high-pressure die pressing and cold isostatic pressing to obtain a powder compact; sintering the powder compact by two-step pressureless sintering, i.e., the first step of sintering is to heat up the powder compact quickly to a specified temperature, hold the powder compact at the temperature for a short time and control the density at 75-85%, and the second step of sintering is to cool down the powder compact to a specified temperature and hold the powder compact at the temperature for a long time to further eliminate residual pores, so as to a obtain high-density ultrafine grain metal.

The specific steps of the method are:

S1: using metal powder as a raw material, and processing the raw material powder by deagglomeration with a high-speed helical blade mixer at 2,000-3,000 rpm blade rotation speed for 0.5-2 h, to obtain deagglomerated powder;

S2: first, mixing a binder and deionized water homogeneously to prepare a solution A, in which the content of the binder is 5-15 wt. %;

then, adding the deagglomerated raw material powder obtained in the step S1 into the solution A and stirring the solution mechanically to a homogeneous state, so as to obtain a slurry;

granulating the obtained slurry by spray granulation with a centrifugal atomizing drier at 8,000-15,000 r/min rotation speed, 100-300 kPa atomizing pressure, and 90-150° C. drying temperature;

loading the granulated powder into a tube heating oven and charging high-purity hydrogen into the tube heating oven for degreasing and reduction at 550-700° C. processing temperature and 5-10° C./min. heating rate, and holding for 60-120 min., to obtain granulated particles in an approximately spherical shape;

S3: pressing the granulated particles by high-pressure die pressing at 700-1,000 MPa pressing pressure, and holding for 0.5-1.5 min. to obtain a preformed powder compact, loading the preformed powder compact into a jacketed mold and performing cold isostatic pressing at 200-280 MPa, and holding for 5-10 min., to obtain a powder compact;

S4: performing two-step sintering: first, in the first step of sintering, heating up the powder compact obtained in the step S3 at a specified heating rate to a temperature $T_1$ and holding at the temperature, to obtain a one-step sintered compact; then, in the second step of sintering, cooling down the one-step sintered compact from the temperature $T_1$ to a temperature $T_2$ at a specified cooling rate, and holding at the temperature, so as to obtain a metal material with ultrafine grains finally, wherein, the temperature $T_2$ is lower than the temperature $T_1$ by 50-250° C., and the holding time in the first step is shorter than the holding time in the second step (as shown in FIG. 1).

In the step S1, the metal powder comprises a refractory metal; the grain size of the deagglomerated powder is smaller than 0.5 μm.

In the step S2, the binder is polyvinyl alcohol, polyethylene glycol, stearic acid or paraffin; the solid content in the slurry is 60-85 wt. %.

In the step S3, the relative density of the powder compact is higher than 50%.

In the first step of sintering in the step S4, the powder compact is sintered in a hydrogen atmosphere by heating up the powder compact to a temperature $T_1$ equal to 1,200-1,500° C. and holding at the temperature for 1-2 h.

In the second step of sintering in the step S4, the shielding gas atmosphere is hydrogen or argon gas atmosphere, the temperature is decreased from the temperature $T_1$ to a temperature $T_2$ at 15-25° C./min. cooling rate, and the holding time is 10-60 h.

The density of the one-step sintered compact is 75-85%, the grain size is 0.5-1 μm, and the pore size and distribution are uniform.

The grain size of the obtained ultrafine grain metal/one-step sintered compact is ≤1.5.

The density of the ultrafine grain metal is higher than 98%.

Embodiment 1

Figure 5:
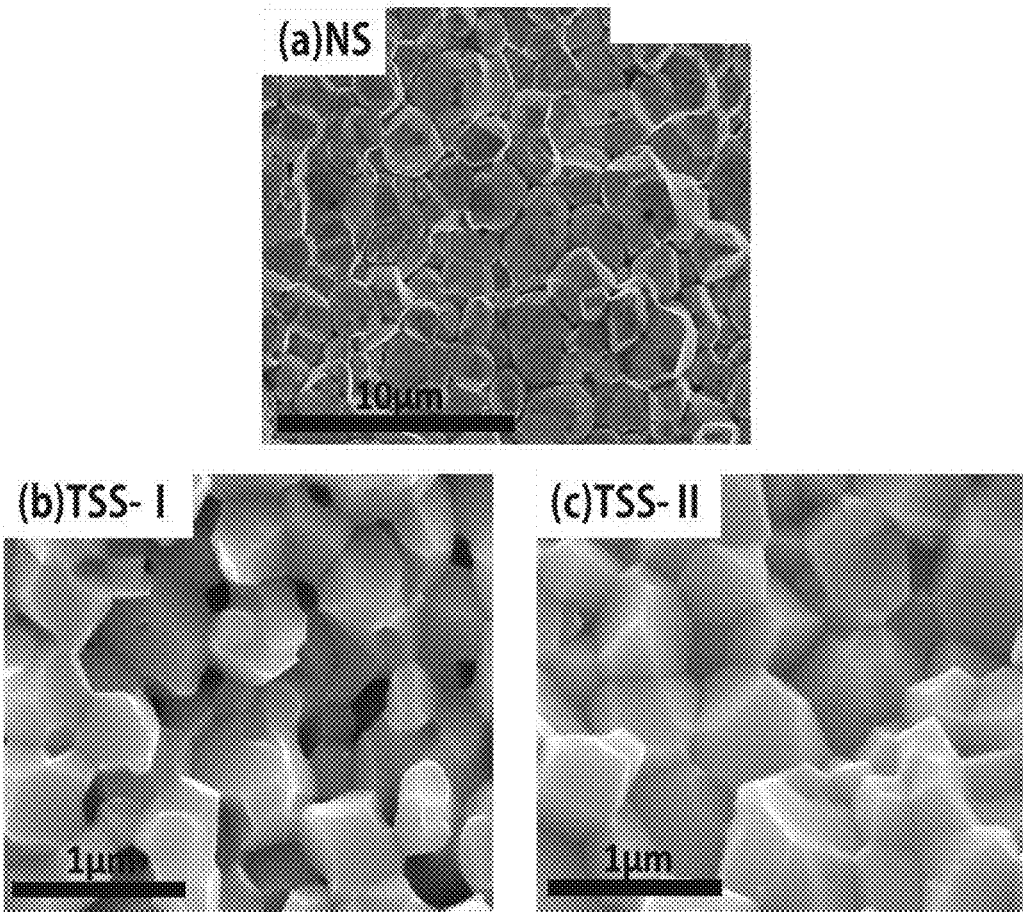
FIG. 5 shows the SEM microstructure of pure tungsten treated through different sintering processes. The raw powder is pure tungsten powder with 50 nm average grain size, (a) shows the state of normal sintering (NS), the holding time at 1,600° C. hydrogen atmosphere is 2 h, and the grain size is about 3 μm; (b) shows the state of the first step of sintering (TSS-I) in the two-step sintering method, the holding time at 1,400° C. temperature in hydrogen gas atmosphere is 1 h, and the grain size is about 0.5 μm; (c) shows the state of the second step of sintering (TSS-II) in the two-step sintering method. The material is held at 1,400° C. temperature in hydrogen atmosphere for 1 h, and then immediately cooled down to 1,250° C. in argon gas atmosphere and held at the temperature for 10 h, and the grain size is about 0.7 μm.

50 nm pure tungsten powder is used as a raw material, the raw material powder is processed by deagglomeration with a high-speed helical blade mixer at 3,000 rpm blade rotation speed for 1 h, to obtain deagglomerated raw material powder with narrow grain size distribution. Polyethylene glycol and deionized water are uniformly mixed to make a solution A with 15 wt. % binder content, and then 50 nm raw tungsten powder is added into the solution A and the solution A is stirred mechanically to a homogenously mixed state to make a slurry with 85 wt. % solid content; the obtained slurry is granulated by spray granulation with a centrifugal atomizing drier at 15,000 r/min. rotation speed, 300 kPa atomizing pressure, and 90° C. drying temperature; the granulated powder is loaded into a tube heating oven, and high-purity hydrogen is charged into the tube heating oven for degreasing and reduction at 700° C. processing temperature and 5° C./min. heating rate, and the temperature is held for 120 min., to obtain granulated particles in an approximately spherical shape; the granulated particles is molded by two-way compression molding at 1,000 MPa pressing pressure, and the pressure is held for 1 min., to obtain a preformed powder compact. The preformed powder compact is loaded into a jacketed mold for vacuum encapsulation, and then processed by cold isostatic pressing at 280 MPa, and the pressure is held for 5 min., to obtain a powder compact; the powder compact is sintered by first-step sintering in hydrogen gas atmosphere at 1400° C. sintering temperature, 15° C./min heating rate, and the temperature is held for 1 h. Then, the compact is cooled rapidly at 20° C./min. cooling rate to the second-step sintering temperature 1,250° C., here, the sintering atmosphere is replaced with argon gas, and the holding time is 10 h. Finally, high-density ultrafine grain tungsten without grain growth is obtained. The microstructure is shown in FIG. 5, the density is 98%, and the average grain size is 0.7 μm.

Embodiment 2

50 nm pure tungsten powder is used as a raw material, the raw material powder is processed by deagglomeration with a high-speed helical blade mixer at 3,000 rpm blade rotation speed for 1 h, to obtain deagglomerated raw material powder with narrow grain size distribution. Polyethylene glycol and deionized water are uniformly mixed to make a solution A with 15 wt. % binder content, and then 50 nm raw tungsten powder is added into the solution A and the solution A is stirred mechanically to a homogenously mixed state to make a slurry with 85 wt. % solid content; the obtained slurry is granulated by spray granulation with a centrifugal atomizing drier at 15,000 r/min. rotation speed, 300 kPa atomizing pressure, and 90° C. drying temperature; the granulated powder is loaded into a tube heating oven, and high-purity hydrogen is charged into the tube heating oven for degreasing and reduction at 700° C. processing temperature and 5° C./min. heating rate, and the temperature is held for 120 min., to obtain granulated particles in an approximately spherical shape; the granulated particles is molded by two-way compression molding at 1,000 MPa pressing pressure, and the pressure is held for 1 min., to obtain a preformed powder compact. The preformed powder compact is loaded into a jacketed mold for vacuum encapsulation, and then processed by cold isostatic pressing at 280 MPa, and the pressure is held for 5 min., to obtain a powder compact; the powder compact is sintered by first-step sintering in hydrogen gas atmosphere at 1300° C. sintering temperature, 15° C./min heating rate, and the temperature is held for 1 h. Then, the compact is cooled rapidly at 20° C./min. cooling rate to the second-step sintering temperature 1,200° C., here, the sintering atmosphere is replaced with argon gas, and the holding time is 20 h. Finally, high-density ultrafine grain tungsten without grain growth is obtained. The density is 97%, and the average grain size is 0.6 μm.

Embodiment 3

200 nm pure tungsten powder is used as a raw material, the raw material powder is processed by deagglomeration with a high-speed helical blade mixer at 2500 rpm blade rotation speed for 1 h, to obtain deagglomerated raw material powder with narrow grain size distribution. Polyethylene glycol and deionized water are uniformly mixed to make a solution A with 10 wt. % binder content, and then 200 nm raw tungsten powder is added into the solution A and the solution A is stirred mechanically to a homogenously mixed state to make a slurry with 70 wt. % solid content; the obtained slurry is granulated by spray granulation with a centrifugal atomizing drier at 12,000 r/min rotation speed, 200 kPa atomizing pressure, and 120° C. drying temperature; the granulated powder is loaded into a tube heating oven, and high-purity hydrogen is charged into the tube heating oven for degreasing and reduction at 600° C. processing temperature and 5° C./min. heating rate, and the temperature is held for 120 min., to obtain granulated particles in an approximately spherical shape; the granulated particles is molded by two-way compression molding at 900 MPa pressing pressure, and the pressure is held for 1 min., to obtain a preformed powder compact. The preformed powder compact is loaded into a jacketed mold for vacuum encapsulation, and then processed by cold isostatic pressing at 250 MPa, and the pressure is held for 5 min., to obtain a powder compact; the powder compact is sintered by first-step sintering in hydrogen gas atmosphere at 1400° C. sintering temperature, 15° C./min heating rate, and the temperature is held for 1 h. Then, the compact is cooled rapidly at 20° C./min. cooling rate to the second-step sintering temperature 1,250° C., here, the sintering atmosphere is replaced with argon gas, and the holding time is 20 h. Finally, high-density ultrafine grain tungsten without grain growth is obtained. The density is 97%, and the average grain size is 1.5 μm.

Embodiment 4

400 nm pure tungsten powder is used as a raw material, the raw material powder is processed by deagglomeration with a high-speed helical blade mixer at 2000 rpm blade rotation speed for 1 h, to obtain deagglomerated raw material powder with narrow grain size distribution. Polyethylene glycol and deionized water are uniformly mixed to make a solution A with 5 wt. % binder content, and then 400 nm raw tungsten powder is added into the solution A and the solution A is stirred mechanically to a homogenously mixed state to make a slurry with 65 wt. % solid content; the obtained slurry is granulated by spray granulation with a centrifugal atomizing drier at 10,000 r/min. rotation speed, 150 kPa atomizing pressure, and 140° C. drying temperature; the granulated powder is loaded into a tube heating oven, high-purity hydrogen is charged into the tube heating oven for degreasing and reduction at 550° C. processing temperature and 5° C./min. heating rate, and the powder is held at the temperature for 120 min., to obtain granulated particles in an approximately spherical shape; the granulated particles is molded by two-way compression molding at 700 MPa pressing pressure, and the pressure is held for 1 min., to obtain a preformed powder compact. The preformed powder compact is loaded into a jacketed mold for vacuum encapsulation, and then processed by cold isostatic pressing at 200 MPa, and the pressure is held for 5 min., to obtain powder compact; the powder compact is sintered by first-step sintering in hydrogen gas atmosphere at 1400° C. sintering temperature, 15° C./min. heating rate, and the temperature is held for 1 h. Then, the compact is cooled rapidly at 20° C./min. cooling rate to the second-step sintering temperature 1,300° C., here, the sintering atmosphere is replaced with argon gas, and the holding time is 30 h. Finally, high-density ultrafine grain tungsten without grain growth is obtained. The density is 97%, and the average grain size is 1.2 μm.

Embodiment 5

Figure 6:
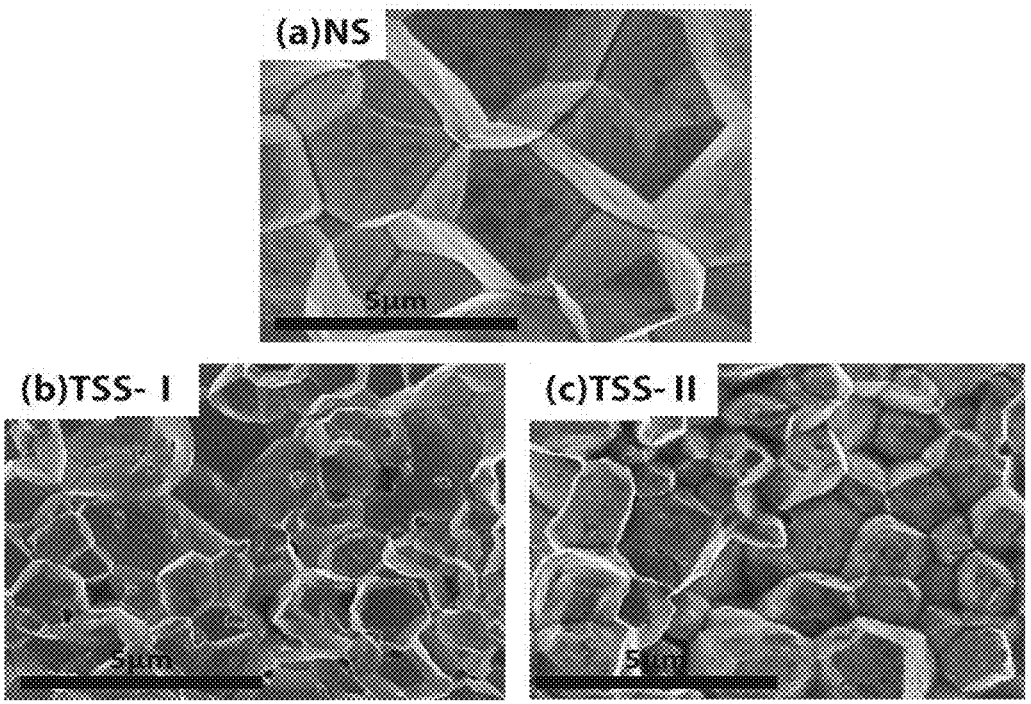
FIG. 6 shows the SEM microstructure of pure molybdenum treated through different sintering processes. The raw powder is pure tungsten powder with 30 nm average grain size, (a) shows the state of normal sintering (NS), the holding time at 1,500° C. hydrogen atmosphere is 2 h, and the grain size is about 5 μm; (b) shows the state of the first step of sintering (TSS-I) in the two-step sintering method, the holding time at 1,250° C. temperature in hydrogen gas atmosphere is 2 h, and the grain size is about 1.5 μm; (c) shows the state of the second step of sintering (TSS-II) in the two-step sintering method. The material is held at 1,250° C. temperature in hydrogen atmosphere for 1 h, and then immediately cooled down to 1,150° C. in argon gas atmosphere and held at the temperature for 40 h, and the grain size is about 2 μm.

30 nm pure molybdenum powder is used as a raw material, the raw material powder is processed by deagglomeration with a high-speed helical blade mixer at 2000 rpm blade rotation speed for 1 h, to obtain deagglomerated raw material powder with narrow grain size distribution. Polyethylene glycol and deionized water are uniformly mixed to make a solution A with 5 wt. % binder content, and then 30 nm raw tungsten powder is added into the solution A and the solution A is stirred mechanically to a homogenously mixed state to make a slurry with 60 wt. % solid content; the obtained slurry is granulated by spray granulation with a centrifugal atomizing drier at 12,000 r/min rotation speed, 150 kPa atomizing pressure, and 140° C. drying temperature; the granulated powder is loaded into a tube heating oven, high-purity hydrogen is charged into the tube heating oven for degreasing and reduction at 550° C. processing temperature and 5° C./min. heating rate, and the powder is held at the temperature for 120 min., to obtain granulated particles in an approximately spherical shape; the granulated particles is molded by two-way compression molding at 700 MPa pressing pressure, and the pressure is held for 2 min., to obtain a preformed powder compact. The preformed powder compact is loaded into a jacketed mold for vacuum encapsulation, and then processed by cold isostatic pressing at 200 MPa, and the pressure is held for 5 min., to obtain powder compact; the powder compact is sintered by first-step sintering in hydrogen gas atmosphere at 1250° C. sintering temperature and 15° C./min. heating rate, and the temperature is held for 1 h. Then, the compact is cooled rapidly at 20° C./min. cooling rate to the second-step sintering temperature 1,150° C., here, the sintering atmosphere is replaced with argon gas, and the holding time is 40 h. Finally, high-density ultrafine grain molybdenum without grain growth is obtained. The microstructure is shown in FIG. 6, the density is 97%, and the average grain size is 2 μm.

Embodiment 6

30 nm pure molybdenum powder is used as a raw material, the raw material powder is processed by deagglomeration with a high-speed helical blade mixer at 2000 rpm blade rotation speed for 1 h, to obtain deagglomerated raw material powder with narrow grain size distribution. Polyethylene glycol and deionized water are uniformly mixed to make a solution A with 5 wt. % binder content, and then 30 nm raw tungsten powder is added into the solution A and the solution A is stirred mechanically to a homogenously mixed state to make a slurry with 60 wt. % solid content; the obtained slurry is granulated by spray granulation with a centrifugal atomizing drier at 12,000 r/min rotation speed, 150 kPa atomizing pressure, and 140° C. drying temperature; the granulated powder is loaded into a tube heating oven, and high-purity hydrogen is charged into the tube heating oven for degreasing and reduction at 550° C. processing temperature and 5° C./min. heating rate for 120 min. holding time, to obtain granulated particles in an approximately spherical shape; the granulated particles is molded by two-way compression molding at 700 MPa pressing pressure, and the pressure is held for 2 min., to obtain a preformed powder compact. The preformed powder compact is loaded into a jacketed mold for vacuum encapsulation, and then processed by cold isostatic pressing at 200 MPa, and the pressure is held for 5 min., to obtain powder compact; the powder compact is sintered by first-step sintering in hydrogen gas atmosphere at 1350° C. sintering temperature, 15° C./min. heating rate and without holding time. Then, the compact is cooled rapidly at 20° C./min cooling rate to the second-step sintering temperature 1,200° C., here, the sintering atmosphere is replaced with argon gas, and the holding time is 40 h. Finally, high-density ultrafine grain molybdenum without grain growth is obtained. The density is 98%, and the average grain size is 1.2 μm.

Embodiment 7

50 nm pure molybdenum powder is used as a raw material, the raw material powder is processed by deagglomeration with a high-speed helical blade mixer at 2000 rpm blade rotation speed for 1 h, to obtain deagglomerated raw material powder with narrow grain size distribution. Polyethylene glycol and deionized water are uniformly mixed to make a solution A with 5 wt. % binder content, and then 50 nm raw tungsten powder is added into the solution A and the solution A is stirred mechanically to a homogenously mixed state to make a slurry with 60 wt. % solid content; the obtained slurry is granulated by spray granulation with a centrifugal atomizing drier at 10,000 r/min rotation speed, 150 kPa atomizing pressure, and 140° C. drying temperature; the granulated powder is loaded into a tube heating oven, high-purity hydrogen is charged into the tube heating oven for degreasing and reduction at 550° C. processing temperature and 5° C./min. heating rate, and the powder is held at the temperature for 120 min., to obtain granulated particles in an approximately spherical shape; the granulated particles is molded by two-way compression molding at 700 MPa pressing pressure, and the pressure is held for 2 min., to obtain a preformed powder compact. The preformed powder compact is loaded into a jacketed mold for vacuum encapsulation, and then processed by cold isostatic pressing at 200 MPa, and the pressure is held for 5 min., to obtain powder compact; the powder compact is sintered by first-step sintering in hydrogen gas atmosphere at 1350° C. sintering temperature, 15° C./min. heating rate and without holding time. Then, the compact is cooled rapidly at 15° C./min. cooling rate to the second-step sintering temperature 1,150° C., here, the sintering atmosphere is replaced with argon gas, and the holding time is 40 h. Finally, high-density ultrafine grain molybdenum without grain growth is obtained. The density is 98%, and the average grain size is 1.3 μm.

Embodiment 8

70 nm pure molybdenum powder is used as a raw material, the raw material powder is processed by deagglomeration with a high-speed helical blade mixer at 2000 rpm blade rotation speed for 1 h, to obtain deagglomerated raw material powder with narrow grain size distribution. Polyethylene glycol and deionized water are uniformly mixed to make a solution A with 5 wt. % binder content, and then 70 nm raw tungsten powder is added into the solution A and the solution A is stirred mechanically to a homogenously mixed state to make a slurry with 60 wt. % solid content; the obtained slurry is granulated by spray granulation with a centrifugal atomizing drier at 8,000 r/min. rotation speed, 150 kPa atomizing pressure, and 140° C. drying temperature; the granulated powder is loaded into a tube heating oven, high-purity hydrogen is charged into the tube heating oven for degreasing and reduction at 550° C. processing temperature and 5° C./min. heating rate, and the powder is held at the temperature for 120 min., to obtain granulated particles in an approximately spherical shape; the granulated particles is molded by two-way compression molding at 700 MPa pressing pressure, and the pressure is held for 2 min., to obtain a preformed powder compact. The preformed powder compact is loaded into a jacketed mold for vacuum encapsulation, and then processed by cold isostatic pressing at 200 MPa, and the pressure is held for 5 min., to obtain powder compact; the powder compact is sintered by first-step sintering in hydrogen gas atmosphere at 1250° C. sintering temperature and 15 r/min. heating rate, and the temperature is held for 2 h. Then, the compact is cooled rapidly at 25° C./min. cooling rate to the second-step sintering temperature 1,200° C., here, the sintering atmosphere is replaced with argon gas, and the holding time is 40 h. Finally, high-density ultrafine grain molybdenum without grain growth is obtained. The density is 97%, and the average grain size is 1.8 μm.

While the present invention has been illustrated and described with reference to some embodiments, the present invention is not limited to these. Those skilled in the art should recognize that various variations and modifications can be made without departing from the spirit and scope of the present invention as defined by the accompanying claims. Therefore, the protected domain of the present invention shall be only confined by the claims.

The foregoing description of the exemplary embodiments of the present invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is the claim is:

1. A metal material sintering densification and grain size control method, comprising the following steps:

first, using metal powder as a raw material powder, processing the raw material powder by deagglomeration to obtain deagglomerated powder; granulating the deagglomerated powder by spray granulation and obtain granulated particles in spherical shape; processing the obtained granulated particles by die pressing and cold isostatic pressing to obtain a powder compact; sintering the powder compact by two-step pressureless sintering, wherein a first step of sintering comprises heating up the powder compact to a first temperature, holding the powder compact at the temperature for a first time and controlling a density at 75-85%, and a second step of sintering comprises cooling down the powder compact to a second temperature and holding the powder compact at the second temperature for a second time to further eliminate residual pores, so as to obtain ultrafine grain metal.

2. The method according to claim 1, comprising the following steps:

S1: processing the raw material powder by deagglomeration with a high-speed helical blade mixer at 2,000-3,000 rpm blade rotation speed for 0.5-2 h, to obtain deagglomerated powder;

S2: first, mixing a binder and deionized water homogeneously to prepare a solution A, in which the content of the binder is 5-15 wt. %;

then, adding the deagglomerated raw material powder obtained in the step S1 into the solution A and stirring the solution mechanically to a homogeneous state, so as to obtain a slurry; granulating the obtained slurry by spray granulation with a centrifugal atomizing drier at 8,000-15,000 r/min. rotation speed, 100-300 kPa atomizing pressure, and 90-150° C. drying temperature;

loading the granulated powder into a tube heating oven and adding hydrogen into the tube heating oven for degreasing and reduction at 550-700° C. processing temperature, 5-10° C./min. heating rate, and holding for 60-120 min., to obtain granulated particles in a spherical shape;

S3: pressing the granulated powder by die pressing at 700-1,000 MPa pressing pressure, and holding for 0.5-1.5 min. to obtain a preformed powder compact, loading the preformed powder compact into a jacketed mold and performing cold isostatic pressing at 200-280 MPa, and holding for 5-10 min., to obtain a powder compact; and S4: performing two-step sintering: first, in the first step of sintering, heating up the powder compact obtained in the step S3 at a first heating rate to a temperature T1 and holding at the temperature T1, to obtain a one-step sintered compact; then, in the second step of sintering, cooling down the one-step sintered compact from the temperature T1 to a temperature T2 at a first cooling rate, and holding at the temperature T2, so as to obtain a metal material with ultrafine grains finally, wherein, the temperature T2 is lower than the temperature T1 by 50-250° C., and the holding time for T1 in the first step is shorter than the holding time for T2 in the second step.

3. The method according to claim 2, wherein in the step S1, the metal powder comprises a refractory metal; the particle size of the deagglomerated powder is smaller than 0.5 μm.

4. The method according to claim 2, wherein in the step S2, the binder is polyvinyl alcohol, polyethylene glycol, stearic acid or paraffin; the solid content in the slurry is 60-85 wt. %.

5. The method according to claim 2, wherein in the step S3, a density of the powder compact is higher than 50%.

6. The method according to claim 2, wherein in the first step of sintering in the step S4, the powder compact is sintered in a hydrogen atmosphere by heating up the powder compact to the temperature T1 at 5° C./min heating rate, the temperature T1 is 1,200-1,500° C. and the holding time for T1 is 1-2 h.

7. The method according to claim 2, wherein in the second step of sintering in the step S4, a shielding gas atmosphere is hydrogen or argon gas atmosphere, the temperature T1 is decreased to the temperature T2 at 15-25° C./min cooling rate, and the holding time for T2 is 10-60 h.

8. The method according to claim 2, wherein the density of the one-step sintered compact is 75-85%, and the grain size is 0.5-1 μm.

9. The method according to claim 2, wherein the ratio of the obtained ultrafine grain metal grain size to the one-step sintered compact grain size is less than or equal to 1.5.

10. The method according to claim 2, wherein the density of the ultrafine grain metal is higher than 98%.

* * * * *